US010794148B2

(12) United States Patent
Williamson

(10) Patent No.: US 10,794,148 B2
(45) Date of Patent: Oct. 6, 2020

(54) SUBSURFACE SAFETY VALVE WITH PERMANENT LOCK OPEN FEATURE

(71) Applicant: Halliburton Energy Services, Inc., Houston, TX (US)

(72) Inventor: Jimmie Robert Williamson, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 224 days.

(21) Appl. No.: 15/777,190

(22) PCT Filed: Mar. 11, 2016

(86) PCT No.: PCT/US2016/022153
§ 371 (c)(1),
(2) Date: May 17, 2018

(87) PCT Pub. No.: WO2017/155549
PCT Pub. Date: Sep. 14, 2017

(65) Prior Publication Data

US 2018/0334883 A1 Nov. 22, 2018

(51) Int. Cl.
*E21B 34/10* (2006.01)
*E21B 34/14* (2006.01)

(52) U.S. Cl.
CPC ..... *E21B 34/102* (2013.01); *E21B 34/14* (2013.01); *E21B 2200/05* (2020.05)

(58) Field of Classification Search
CPC ... E21B 34/102; E21B 34/14; E21B 2034/005
See application file for complete search history.

(56) References Cited

U.S. PATENT DOCUMENTS 5,249,630 A 10/1993 Meaders et al.
6,736,012 B1 5/2004 Beall et al.
(Continued)

FOREIGN PATENT DOCUMENTS

EP 0715056 A2 6/1996
WO WO-2014014451 A1 1/2014

OTHER PUBLICATIONS

International Search Report and Written Opinion from PCT/US2016/022153, dated Nov. 29, 2016, 11 pages.

*Primary Examiner* — Tara Schimpf
*Assistant Examiner* — Dany E Akakpo
(74) *Attorney, Agent, or Firm* — McGuirewoods, LLP

(57) ABSTRACT

A well system includes a tubing string and a subsurface safety valve interconnected with the tubing string and including a housing that defines a central flow passageway and includes a flapper pivotable within the central flow passageway between closed and open positions. A flow tube is positioned within the central flow passageway and engageable with the flapper to move the flapper to the open position. An actuation piston is operatively coupled to the flow tube, a balance piston is operatively coupled to the flow tube, and a lock-open piston is engageable with an actuator sleeve operatively coupled to the flow tube. A lock-open tool is positionable within the central flow passageway to convey hydraulic pressure into a lock-open piston bore and thereby actuate the lock-open piston to an actuated position that moves the flow tube and permanently locks the flapper in the open position.

20 Claims, 11 Drawing Sheets

(56) References Cited

U.S. PATENT DOCUMENTS

| | | | | |
|---|---|---|---|---|
| 8,016,035 | B2 | 9/2011 | Strattan et al. | |
| 2009/0294135 | A1 | 12/2009 | Jacob et al. | |
| 2009/0294136 | A1 | 12/2009 | Jones et al. | |
| 2010/0230109 | A1* | 9/2010 | Lake ..... | E21B 34/10 166/332.8 |
| 2011/0048726 | A1 | 3/2011 | Aarnes et al. | |
| 2013/0299200 | A1 | 11/2013 | Hughes et al. | |
| 2014/0196912 | A1 | 7/2014 | Turley et al. | |

* cited by examiner

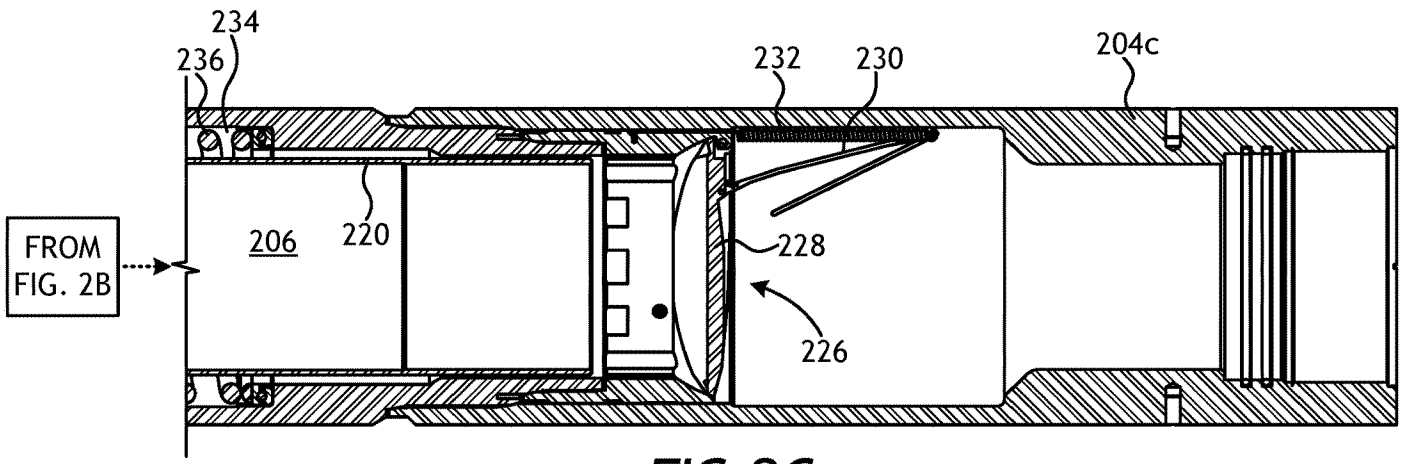
FIG. 2C
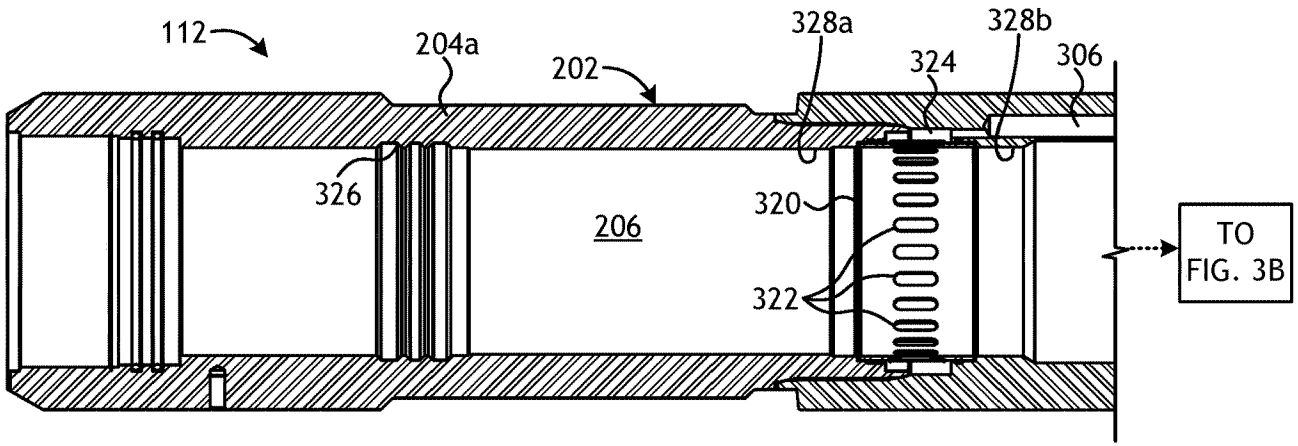
FIG. 3A
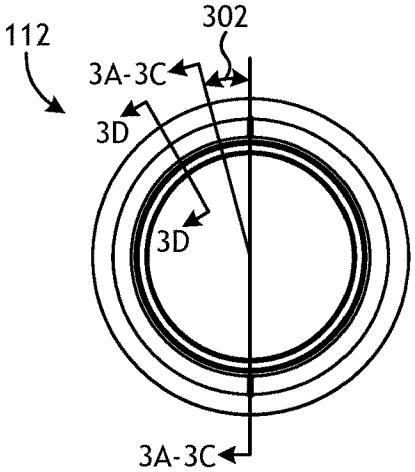

SUBSURFACE SAFETY VALVE WITH PERMANENT LOCK OPEN FEATURE

BACKGROUND

Subsurface safety valves (SSSV) are commonly installed as part of production tubing within oil and gas wells to protect against unwanted communication of high pressure and high temperature formation fluids to the well surface. These subsurface safety valves are designed to shut in fluid production from subterranean formations in response to a variety of abnormal and potentially dangerous conditions.

As built into the production tubing, SSSVs are typically referred to as tubing retrievable safety valves (TRSV) since they can be retrieved by retracting the production tubing back to surface. TRSVs are normally operated by hydraulic fluid pressure controlled at the surface and transmitted to the TRSV via hydraulic control lines. Accordingly, surface controlled TRSVs can also be referred to as tubing retrievable surface controlled subsurface safety valves (TRSC-SSV).

TRSVs typically include a check valve, such as a flapper valve. The flapper valve includes a closure member or "flapper" that is pivotably mounted between an open position and a closed position. Hydraulic fluid pressure must be applied to the TRSV to place the TRSV in the open position. When hydraulic fluid pressure is lost, however, the TRSV will automatically transition to the closed position to prevent formation fluids from traveling uphole through the TRSV and reaching the surface. As such, TRSVs are commonly characterized as fail-safe valves.

As TRSVs are often subjected to years of service in severe operating conditions, failure of the TRSV is possible. For example, a TRSV in the closed position may eventually form leak paths. Alternatively, a TRSV in the closed position may not properly open when actuated. If a TRSV fails in the closed position, it needs be moved to and permanently locked in the open position so that production operations may continue.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIGS. 2A-2C are progressive cross-sectional side views of an exemplary embodiment of the safety valve of FIG. 1, as taken along lines 2A-2C.

FIGS. 3A-3C are progressive cross-sectional side views of the safety valve of FIG. 1, as taken along lines 3A-3C in the depicted end view.

DETAILED DESCRIPTION

The present disclosure is related to subsurface safety valves and, more particularly, to subsurface safety valve that includes a lock-open piston used to permanently lock the subsurface safety valve in the open position when actuated.

The embodiments disclosed herein provide a subsurface safety valve that can be permanently locked open using a lock-open tool and a corresponding lock-open piston arranged in the subsurface safety valve. The subsurface safety valve is interconnected with tubing string extended within a wellbore and includes a housing that defines a central flow passageway and includes a flapper pivotable within the central flow passageway between closed and open positions. A flow tube is movably positioned within the central flow passageway and engageable with the flapper to move the flapper to the open position. An actuation piston is movably positioned within an actuation piston bore defined in a wall of the housing and operatively coupled to the flow tube, and balance piston is movably positioned within a balance piston bore defined in the wall and operatively coupled to the flow tube. A lock-open piston is movably positioned within a lock-open piston bore defined in the wall and engageable with an actuator sleeve operatively coupled to the flow tube. A lock-open tool is positionable within the central flow passageway to convey hydraulic pressure into the lock-open piston bore and thereby actuate the lock-open piston to an actuated position that moves the flow tube within the central flow passageway and permanently locks the flapper in the open position.

Figure 1:
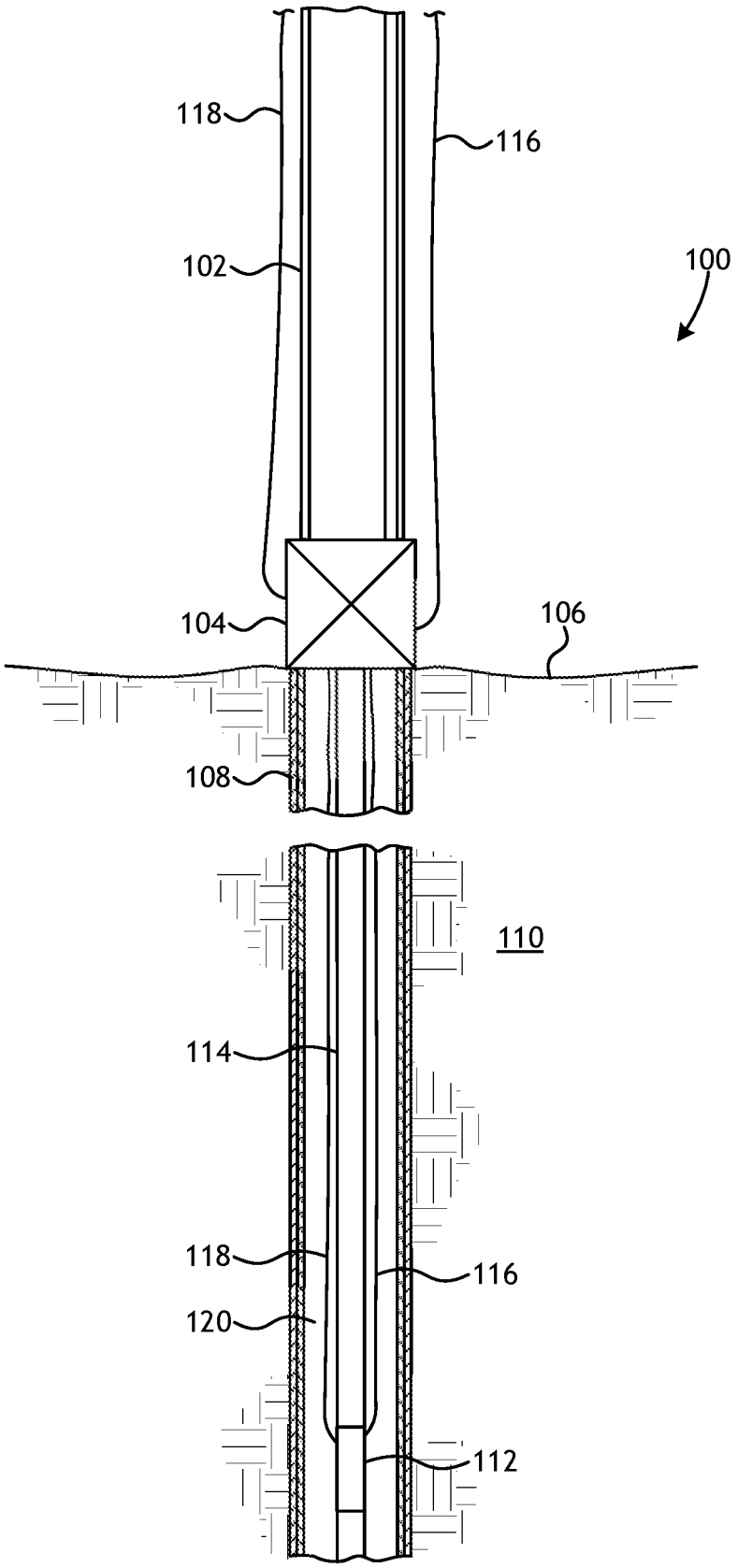
FIG. 1 illustrates a well system that can incorporate the principles of the present disclosure.

FIG. 1 is a well system 100 that can incorporate one or more principles of the present disclosure, according to one or more embodiments. As illustrated, the well system 100 may include a riser 102 extending from a wellhead installation 104 positioned at a sea floor 106. The riser 102 may extend to a surface location, such as to an offshore oil and gas platform (not shown). A wellbore 108 extends downward from the wellhead installation 104 through various subterranean formations 110. The wellbore 108 is depicted as being cased, but it could equally be an uncased wellbore 108, without departing from the scope of the disclosure. Although FIG. 1 depicts the well system 100 in the context of an offshore oil and gas application, it will be appreciated by those skilled in the art that the various embodiments disclosed herein are equally well suited for use in land-based applications located at any geographical site. Thus, it should be understood that this disclosure is not limited to any particular type of well.

The well system 100 may further include a subsurface safety valve 112 (hereafter "the safety valve 112") interconnected with a tubing string 114 introduced into the wellbore 108 and extending from the wellhead installation 104. The tubing string 114, which may comprise production tubing, may provide a fluid conduit for communicating fluids (e.g., hydrocarbons) extracted from the subterranean formations 110 to the well surface via the wellhead installation 104. A control line 116 and a balance line 118 may each extend to the wellhead installation 104, which, in turn, conveys the control and balance lines 116, 118 into an annulus 120 defined between the wellbore 108 and the tubing string 114. The control and balance lines 116, 118 may originate from a control manifold or pressure control system (not shown) located at the well surface (i.e., a production platform), a subsea control station, or a pressure control system located at the earth's surface or downhole. The control and balance lines 116, 118 extend from the wellhead installation 104 within the annulus 120 and eventually communicate with the subsurface safety valve 112.

As built into the tubing string 114, the safety valve 112 may be referred to as a tubing retrievable safety valve (TRSV). The control line 116 may be used to actuate the safety valve 112 between open and closed positions. More particularly, the control line 116 is a hydraulic conduit that conveys hydraulic fluid to the safety valve 112. The hydraulic fluid is applied under pressure to the control line 116 to open and maintain the safety valve 112 in its open position, thereby allowing production fluids to flow uphole through the safety valve 112, through the tubing string 114, and to a surface location for production. To close the safety valve 112, the hydraulic pressure in the control line 116 is reduced or eliminated. In the event the control line 116 is severed or rendered inoperable, or if there is an emergency at a surface location, the default position for the safety valve 112 is to the closed position to prevent fluids from advancing uphole past the safety valve 112 and otherwise preventing a blowout.

The balance line 118 supplies a balancing hydraulic force to compensate for the effects of hydrostatic pressure acting on the control line 116. More particularly, in order to enable the safety valve 112 to operate at increased depths, it is often necessary to balance the downhole hydrostatic forces assumed by the safety valve 112. The balance line 118 supplies hydraulic pressure to the safety valve 112 to provide a compensating force that overcomes such hydrostatic forces, thereby allowing the safety valve 112 to operate at increased wellbore depths.

Figure 2A:
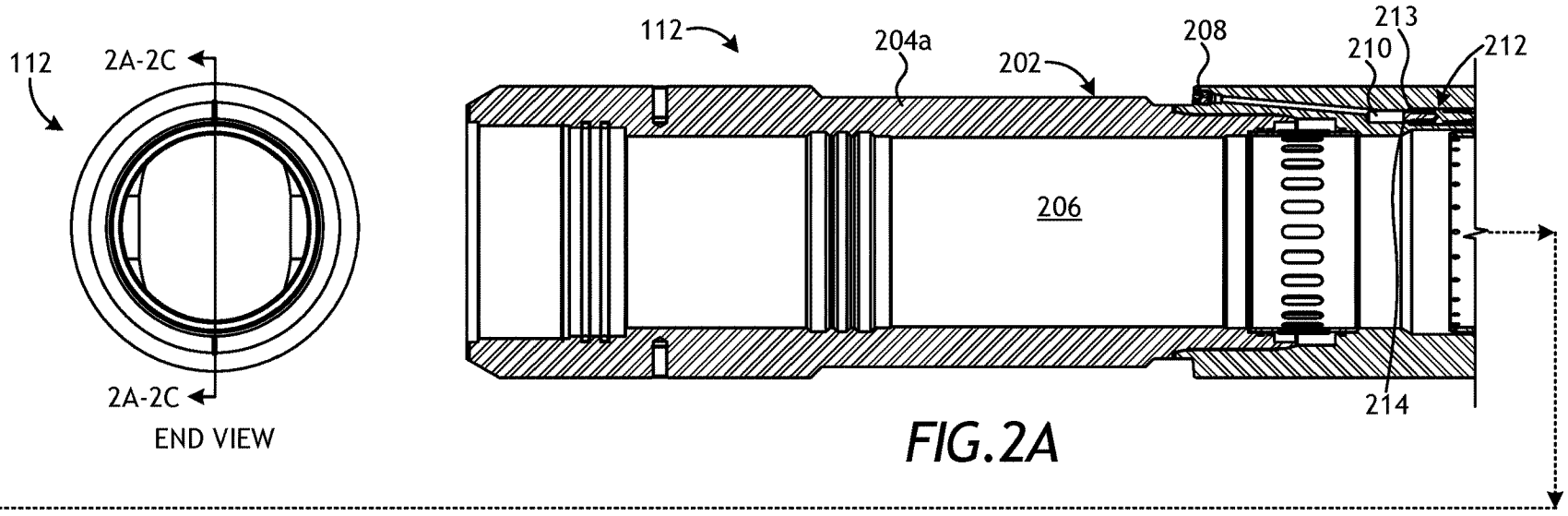
Figure 2B:
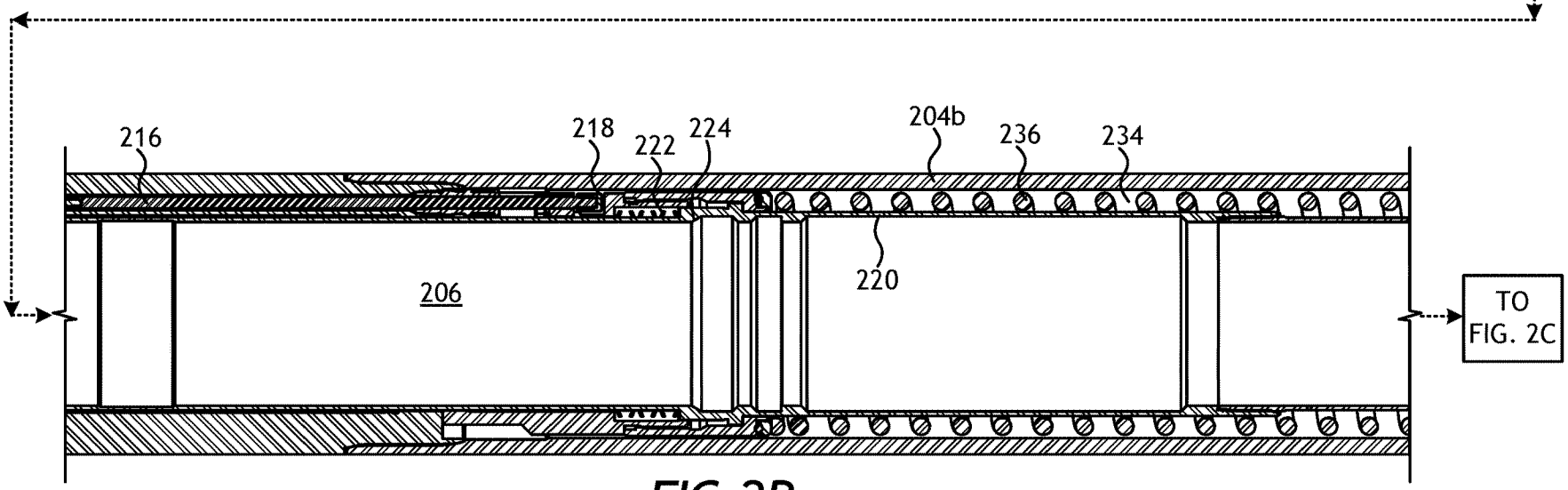

FIGS. 2A-2C depict progressive cross-sectional side views of an exemplary embodiment of the safety valve 112 of FIG. 1, as taken along the lines 2A-2C shown in the depicted end view. The safety valve 112 is depicted in FIGS. 2A-2C in successive sectional views, where FIG. 2A depicts an upper portion of the safety valve 112, FIG. 2B depicts a successive central portion of the safety valve 112, and FIG. 2C depicts a successive lower portion of the safety valve 112. As illustrated, the safety valve 112 may include a housing 202, which includes an upper sub 204*a* (FIG. 2A), a central sub 204*b* (FIG. 2B), and a lower sub 204*c* (FIG. 2C) each operatively coupled to form the housing 202. The housing 202 may define a central flow passageway 206 that extends along the length of the housing 202 between the upper and lower subs 204*a,c*. The upper and lower subs 204*a,c* may each be configured to be operatively coupled to upper and lower portions, respectively, of the tubing string 114 (FIG. 1). As used herein, the term "operatively coupled" refers to a direct or indirect coupling engagement between two components via any known coupling means, such as threading, mechanical fasteners (e.g., bolts, screws, pins, etc.), welding, or any combination thereof.

A control line port 208 is provided in the housing 202 for connecting the control line 116 (FIG. 1) to the safety valve 112. When appropriately connected to the control line port 208, the control line 116 is placed in fluid communication with an actuation piston bore 210 defined in the housing 202 and able to convey control line pressure thereto. The actuation piston bore 210 is an elongate channel or conduit that extends longitudinally along a portion of the axial length of the safety valve 112. As used herein, "control line pressure" refers to the fluid pressure exerted by the hydraulic fluid provided in the control line 116.

An actuation piston 212 is arranged within the actuation piston bore 210 and is configured to translate axially therein. The actuation piston 212 includes a piston head 214 matable with an up stop 213 defined within the actuation piston bore 210 when the actuation piston 212 is forced upwards in the direction of the control line port 208. The up stop 213, for example, may comprise a radial shoulder defined within the actuation piston bore 210 and having a reduced diameter surface configured to engage a corresponding surface of the piston head 214. In other embodiments, the up stop 213 may be any device or means in the actuation piston bore 210 that stops the axial movement of the actuation piston 212 as it advances toward the control line port 208.

The actuation piston 212 also includes a piston rod 216 extending longitudinally from the head 214 through at least a portion of the actuation piston bore 210. At a distal end thereof, the piston rod 216 is coupled to an actuator sleeve 218, which may effectively couple the actuation piston 212 to a flow tube 220 movably arranged within the central flow passageway 206. More particularly, the actuator sleeve 218 may engage a biasing device 222 (e.g., a compression spring, a series of Belleville washers, or the like) arranged axially between the actuator sleeve 218 and an actuation flange 224 that forms part of the flow tube 220. As the actuator sleeve 218 acts on the biasing device 222 with axial force transmitted from the actuation piston 212, the actuation flange 224 and the flow tube 220 correspondingly move axially in the same direction.

As shown in FIG. 2C, the safety valve 112 further includes a flapper valve 226 and an associated flapper 228 that is selectively movable between open and closed positions to either prevent or allow fluid flow through the central flow passageway 206 in the uphole direction. The flapper valve 226 is shown in FIG. 2C in its closed position where the flapper 228 substantially blocks fluid flow in the uphole direction (i.e. to the left in FIGS. 2A-2C) within the central flow passageway 206. In the illustrated embodiment, a flapper arm 230 engages the backside of the flapper 228 and urges the flapper 228 to its closed position as acted upon by a flapper spring 232. In other embodiments, a torsion spring (not shown) may alternatively urge the flapper 228 to its closed position.

The flow tube 220 is able to displace downward (i.e., to the right in FIGS. 2A-2C) to engage and open the flapper 228 by overcoming the spring force of the flapper spring 232 and any hydrostatic pressure within the central flow passageway 206. As described below, axial movement of the actuation piston 212 within the actuation piston bore 210 will force the flow tube 220 to correspondingly move axially within the central flow passageway 206 to engage the flapper 228. When the flow tube 220 is extended to its downward position, it picots the flapper 228 from its closed position to an open position (shown in FIG. 3C). When the flow tube 220 is displaced back upward (i.e., to the left in FIGS. 2A-2C), the flapper spring 232 and the flapper arm 230 cooperatively act to pivot the flapper 228 back to its closed position.

The safety valve 112 further defines a lower chamber 234 within the housing 202, which may form part of the actuation piston bore 210, such as being an elongate extension thereof. A power spring 236, such as a coil or compression spring, may be arranged within the lower chamber 234. The power spring 236 biases the actuation flange 224 and actuation sleeve 218 upwardly which, in turn, biases the actuation piston 212 in the same direction. Accordingly, expansion of the power spring 236 causes the actuation piston 212 to move upwardly within the actuation piston bore 210.

It should be noted that while the power spring 236 is depicted as a coiled compression spring, any type of biasing device may be used instead of, or in addition to, the power spring 236, without departing from the scope of the disclosure. For example, a compressed gas, such as nitrogen, with appropriate seals may be used in place of the power spring 236. In other embodiments, the compressed gas may be contained in a separate chamber and tapped when needed.

Exemplary operation of the safety valve 112 to selectively open and close the flapper 228 is now provided. Control line pressure is conveyed to the control line port 208 via the control line 116 (FIG. 1), which forces the actuation piston 212 to move axially downward within the actuation piston bore 210. The piston rod 216 mechanically transfers the hydraulic force to the actuation sleeve 218 and the actuation flange 224, thereby correspondingly displacing the flow tube 220 in the downward direction. In other words, as the actuation piston 212 moves axially within the actuation piston bore 210, the flow tube 220 correspondingly moves in the same direction. As the flow tube 220 moves downward, it engages the flapper 228, overcomes the spring force of the flapper spring 232, and thereby pivots the flapper 228 to its open position to permit fluids to enter the flow passageway 206 from downhole.

As the actuation piston 212 moves axially downward within the actuation piston bore 210, the power spring 236 is compressed within the lower chamber 234 and progressively builds spring force. In at least one embodiment, the actuation piston 212 will continue its axial movement in the downward direction, and thereby continue to compress the power spring 236, until engaging a down stop arranged within the actuation piston bore 210. A metal-to-metal seal may be created between the actuation piston 212 and the down stop such that the migration of fluids (e.g., hydraulic fluids, production fluids, etc.) therethrough is generally prevented.

When it is desired to close the flapper 228, the control line pressure provided via the control line 116 may be reduced or eliminated, thereby allowing the power spring 236 to expand and displace the actuation piston 212 upwards within the actuation piston bore 210, and thereby correspondingly move the flow tube 220 in the same direction. As the flow tube 220 moves axially upwards, it moves out of engagement with the flapper 228, thereby allowing the flapper arm 230 and the flapper spring 232 to pivot the flapper 228 back into its closed position.

The actuation piston 212 will continue its axial movement in the upward direction until the piston head 214 of the actuation piston 212 engages the up stop 213 and effectively prevents the actuation piston 212 from further upward movement. Engagement between the piston head 214 and the up stop 213 generates a mechanical metal-to-metal seal between the two components to prevent the migration of fluids (e.g., hydraulic fluids, production fluids, etc.) therethrough.

Figure 3B:
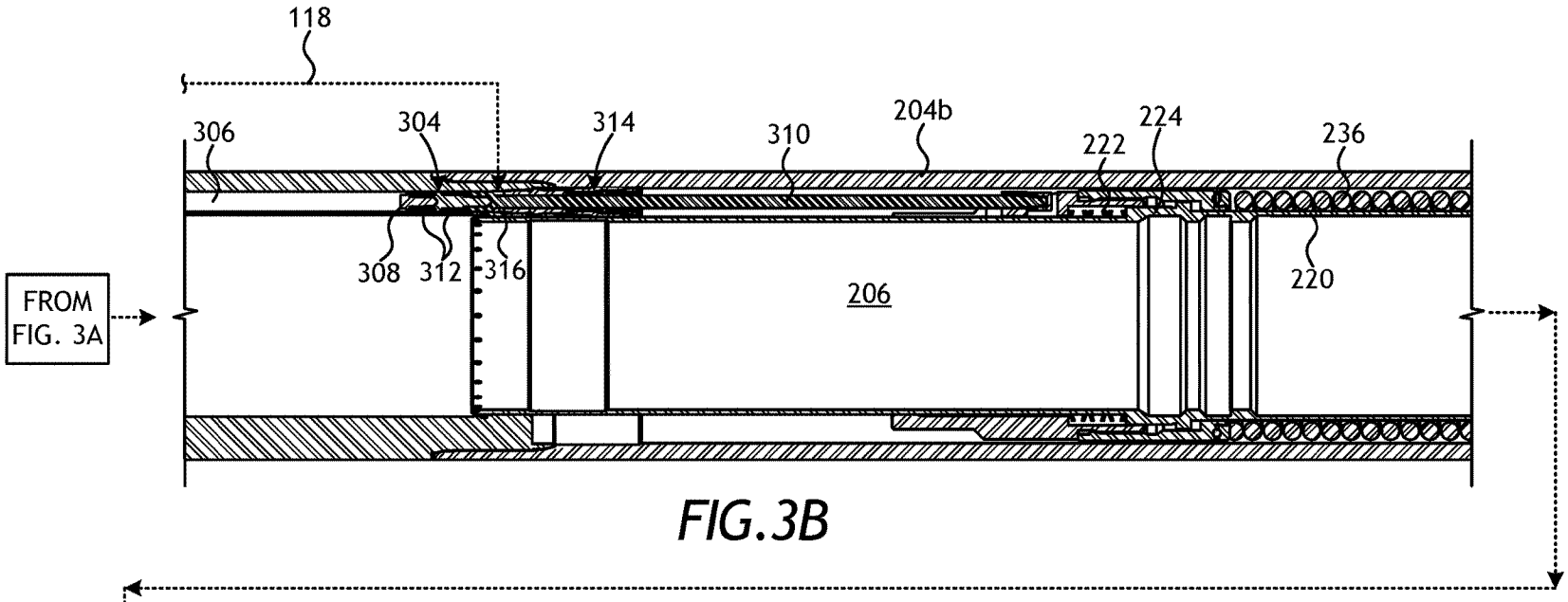
Figure 3C:
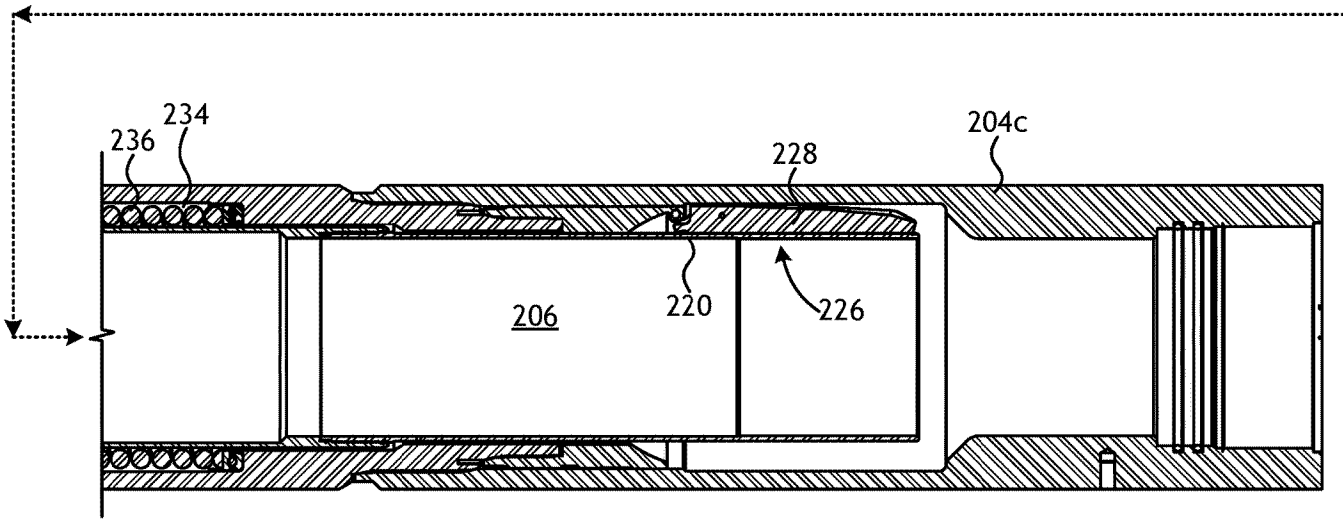

FIGS. 3A-3C are progressive cross-sectional side views of the safety valve 112 as taken along lines 3A-3C shown in the depicted end view. Similar to FIGS. 2A-2C, FIGS. 3A-3C are successive sectional views of the safety valve 112, but instead viewed at an angular offset 302 with respect to the view taken along lines 2A-2C of FIGS. 2A-2C. Accordingly, the actuation piston bore 210 and associated actuation piston 212 are not depicted in FIGS. 3A-3C. Rather, a balance piston 304 is shown as arranged within a balance piston bore 306 defined in the housing 202 and, more particularity, within the central sub 204*b*. Moreover, FIGS. 3A-3C also depict the safety valve 112 in the actuated configuration, where the flow tube 220 is extended downwards to prop the flapper 228 into the open position, as shown in FIG. 3C.

In some embodiments, the angular offset 302 may be about 15°. Consequently, in such embodiments, the actuation piston bore 210 and the balance piston bore 306 are angularly offset from each other within the wall of the housing 202 (i.e., the central sub 204*b*) by about 15°. It will be appreciated, however, that the angular offset 302 may be more or less than 15°, without departing from the scope of the disclosure.

As illustrated, the balance piston 304 includes a head 308 and a balance piston rod 310 that extends longitudinally from the head 308 through at least a portion of the balance actuation piston bore 210. At a distal end thereof, the balance piston rod 310 is coupled to the actuator sleeve 218, which effectively couples the balance piston 304 to the flow tube 220. Accordingly, as the safety valve 112 is actuated and the flow tube 220 moves in the downhole direction, the balance piston 304 correspondingly moves axially within the balance piston bore 306.

The balance piston 304 may include a set of dynamic seals 312 at or near the head 308 to seal against the inner diameter of the balance piston bore 306 as the balance piston 304 moves therein. As used herein, the term "dynamic seal" is used to indicate a seal that provides pressure and/or fluid isolation between members that have relative displacement therebetween, for example, a seal that seals against a displacing surface, or a seal carried on one member and sealing against the other member. The dynamic seals 312 may be made of a variety of materials including, but not limited to, an elastomeric material, a metal, a composite, a rubber, a ceramic, any derivative thereof, and any combination thereof. In some embodiments, the dynamic seals 312 may comprise one or more O-rings or the like. In other embodiments, however, the dynamic seals 312 may comprise a set of v-rings or CHEVRON® packing rings, or another appropriate seal configuration (e.g., seals that are round, v-shaped, u-shaped, square, oval, t-shaped, etc.), as generally known to those skilled in the art.

As shown in FIG. 3B, a lower seal stack 314 may be secured within the balance piston bore 306 and arranged about the balance piston rod 310. The lower seal stack 314 may be configured to dynamically seal against the outer surface of the balance piston rod 310 as the balance piston 304 axially translates within the balance piston bore 306. The lower seal stack 314 may also sealingly engage the inner wall of the balance piston bore 306, and thereby provides a point of fluid isolation within the balance piston bore 306.

A balance chamber 316 may be defined in the balance piston bore 306 between the dynamic seals 312 and the lower seal stack 314. The balance line 118 may be communicably coupled to the balance chamber 316 via a balance line port 318 (FIG. 3D) that provides balance line pressure to the balance chamber 316. As used herein, "balance line pressure" refers to the fluid pressure exerted by the hydraulic fluid provided in the balance line 118. Since the lower seal stack 314 remains stationary within the balance piston bore 306, as the balance piston 304 axially translates within the balance piston bore 306, the volume of the balance chamber 316 correspondingly increases or decreases.

As shown in FIG. 3A, the safety valve further includes a filter 320 positioned within the central flow passageway 206 and defining a plurality of slots 322. The filter 320 facilitates fluid communication between the central flow passageway 206 and a filter chamber 324 defined in the housing 202. The filter chamber 324 may be in fluid communication with the balance piston bore 306 and, therefore, tubing pressure is able to enter the balance piston bore 306 uphole from the balance piston 304 via the filter 320 (i.e., the slots 322) and the filter chamber 324. As used herein, "tubing pressure" refers to the hydraulic pressure exerted by the fluid present in the central flow passageway 206 and, therefore, in the tubing string 114 (FIG. 1). Accordingly, tubing pressure impinges upon the balance piston 304 on its uphole end and fights against the balance line pressure within the balance chamber 316. The slots 322 serve to filter out particulates or debris of a predetermined size in the tubing pressure, and thereby help maintain the integrity of the dynamic seals 312 within the balance piston bore 306.

The balance piston 304 enables the safety valve 112 to operate at depths where the biasing force provided by the power spring 236 would be overcome by the hydrostatic force of the control line pressure in the control line 116 (FIG. 1). As indicated above, the balance piston 304 is exposed to tubing pressure at its uphole end above the dynamic seals 312. It is exposed to the balance line pressure below the dynamic seals 314. Moreover, since the flow tube 220 is not sealed within the housing 202, the bottom ends of the actuation piston 212 (FIG. 2A) and the balance piston 304 below the lower seal stack 314 are each exposed to the tubing pressure. The lower end of the balance piston rod 310 exhibits a reduced diameter, and the area of the control line pressure within the actuation piston bore 210 (FIGS. 2A-2B) is equal to the area of the upper end of the balance piston 304 minus the area of the balance piston rod 310 at its lower end. As a result, the actuation piston 212 (FIG. 2A) is pressure balanced with the tubing pressure, so the tubing pressure does not have to be overcome in order to open the flapper 228 (FIGS. 2C and 3C). Instead of having to overcome the tubing pressure to move the flow tube 220 and thereby open the flapper 228, the control line pressure only has to overcome friction and the spring force of the closure spring 236. The balance line pressure provided to the balance chamber 316 helps to counteract the hydrostatic head of the fluid in the control line 116.

Figure 3D:
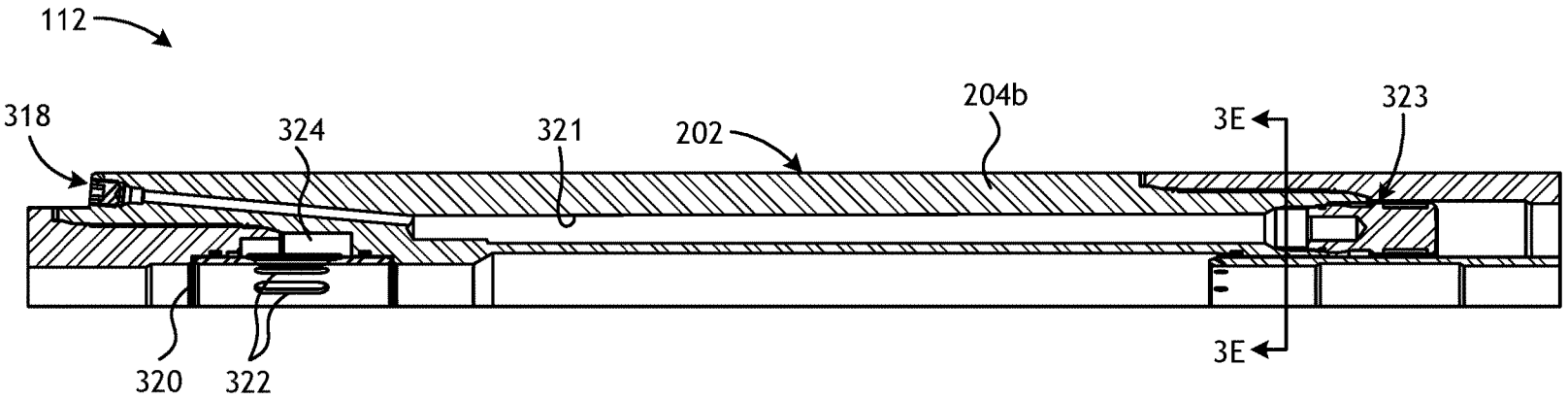
FIG. 3D is a cross-sectional side view of a portion of the safety valve of FIG. 1, as taken along lines 3D in the depicted end view.

FIG. 3D is a cross-sectional side view of a portion of the safety valve 112 taken along lines 3D shown in the depicted end view. More particularly, FIG. 3D depicts the balance line port 318 provided in the housing 202 for connecting the balance line 118 (FIG. 1) to the safety valve 112. When appropriately connected to the balance line port 318, the balance line 118 is placed in fluid communication with a balance piston relief bore 321, which fluidly communicates with the balance chamber 316 (FIGS. 3B, 5B, 6B). A metal-to-metal sealing plug 323 is positioned in the balance piston relief bore 321 and provides a point of fluid isolation, where balance line pressure is uphole from the sealing plug 323 and tubing pressure is downhole from the sealing plug 323.

Figure 3E:
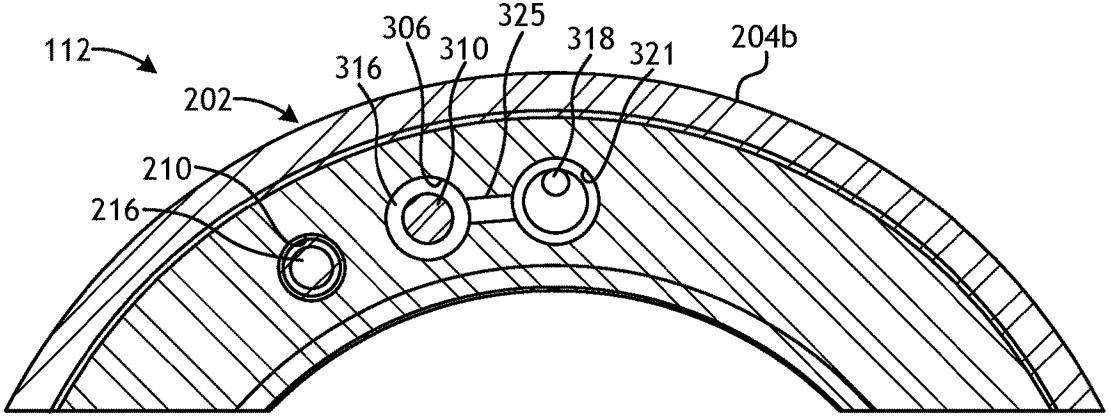
FIG. 3E is a cross-sectional end view taken along the lines 3E of FIG. 3D.

FIG. 3E is a cross-sectional end view of the safety valve 112 taken along the lines 3E of FIG. 3D. As illustrated, the balance piston relief bore 321 is able to fluidly communicate with the balance piston bore 306 via a transition conduit 325 extending between the balance piston relief bore 321 and the balance piston bore 306. The transition conduit 325 can be, for example, a hole that is drilled (e.g., electrical discharge machining) into the housing 202 to access the balance piston bore 306 and, more particularly, the balance chamber 316. The actuation piston bore 210 and the actuation piston rod 216 are also depicted in FIG. 3E as being angularly offset from the balance piston relief bore 321 and the balance piston bore 306.

Referring again to FIGS. 3A-3C, if the safety valve 112 fails with the flapper 228 in the closed position, an intervention operation must be undertaken to lock open the flapper 228 so that further production operations of the well can resume when desired. According to embodiments of the present disclosure, this may be accomplished by landing a lock-open tool (not shown) in the safety valve 112 and actuating a lock-open piston (not shown) to extend the flow tube 220 and permanently prop the flapper 228 in the open position. More particularly, and as will be discussed in more detail below, the lock-open tool may be configured to land on a no-go profile 326 defined on the inner wall of the housing 202 (i.e., the upper sub 204*a*) within the central flow passageway 206. In some embodiments, the no-go profile 326 may comprise a proprietary RPT® profile commercially available through Halliburton Energy Services of Houston, Tex., USA. In other embodiments, however, the no-go profile may simply comprise a reduced diameter portion of the central flow passageway 205. The lock-open tool may include upper and lower seals (not shown) configured to seal against an upper seal bore 328*a* and a lower seal bore 328*b* defined on the inner surface of the housing 202 and provided on either axial end of the filter 320. Once the lock-open tool seals across the filter 320, the tubing pressure is increased to actuate the lock-open piston (not shown) and permanently prop the flapper 228 in the open position, and thereby lock the safety valve 112 in the open configuration.

Figure 4A:
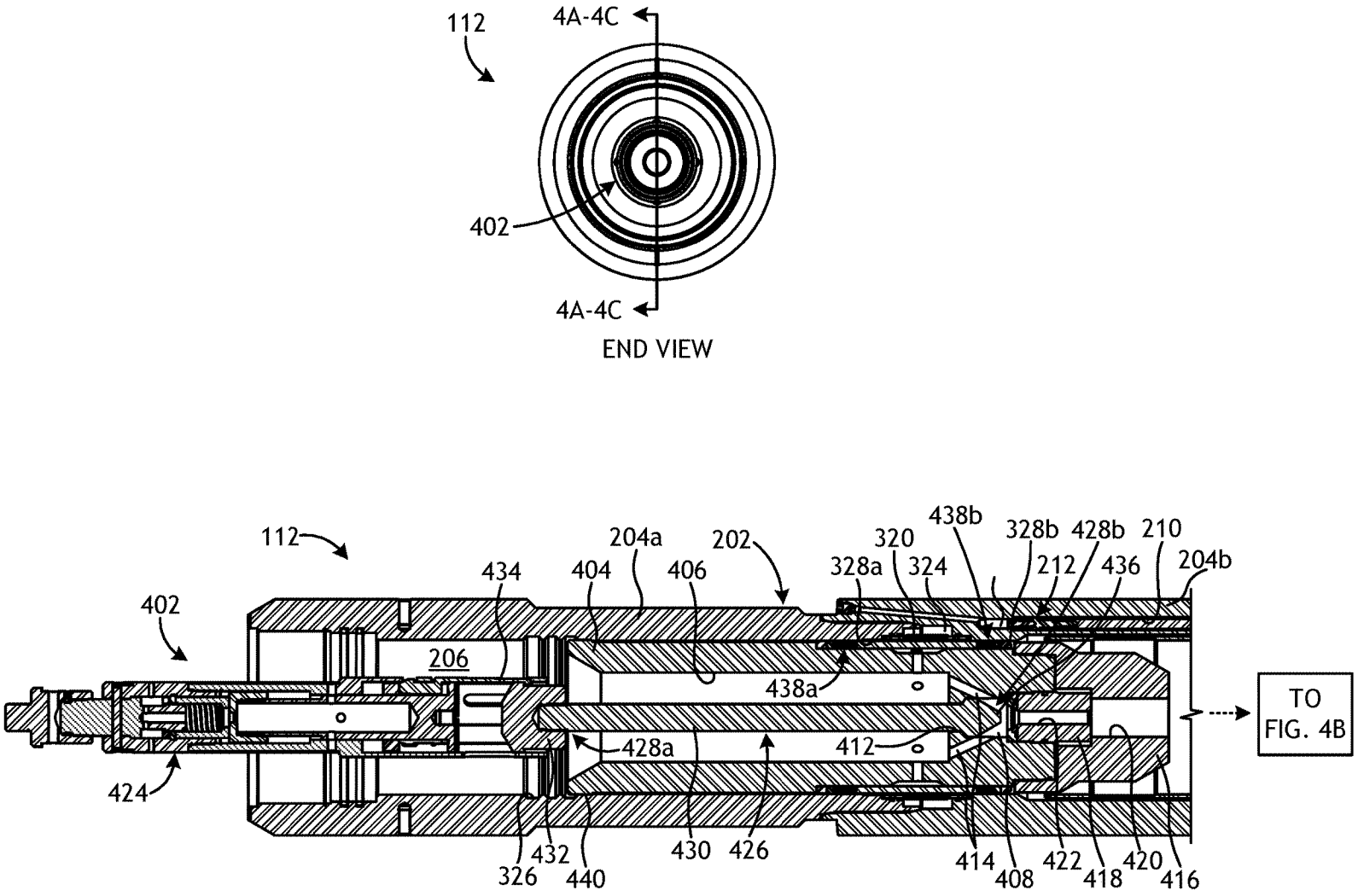
FIGS. 4A-4C are progressive cross-sectional side views of the safety valve of FIG. 1, as taken along lines 4A-4C in the depicted end view.
Figure 4B:
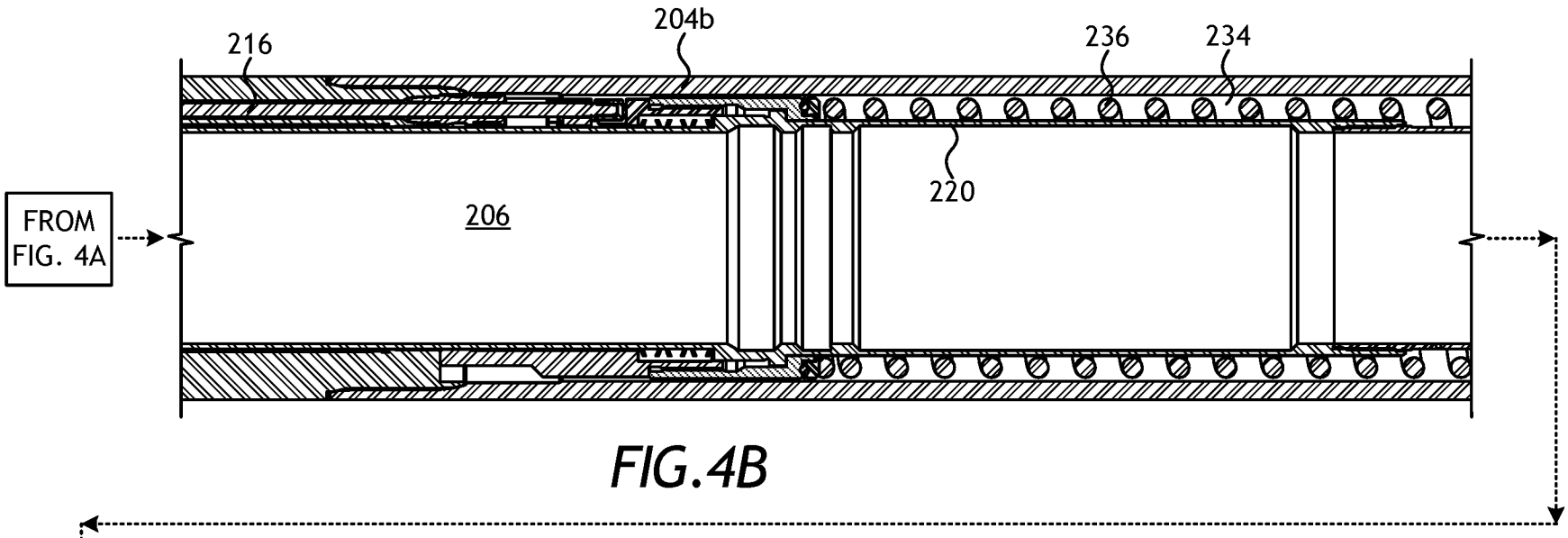
Figure 4C:
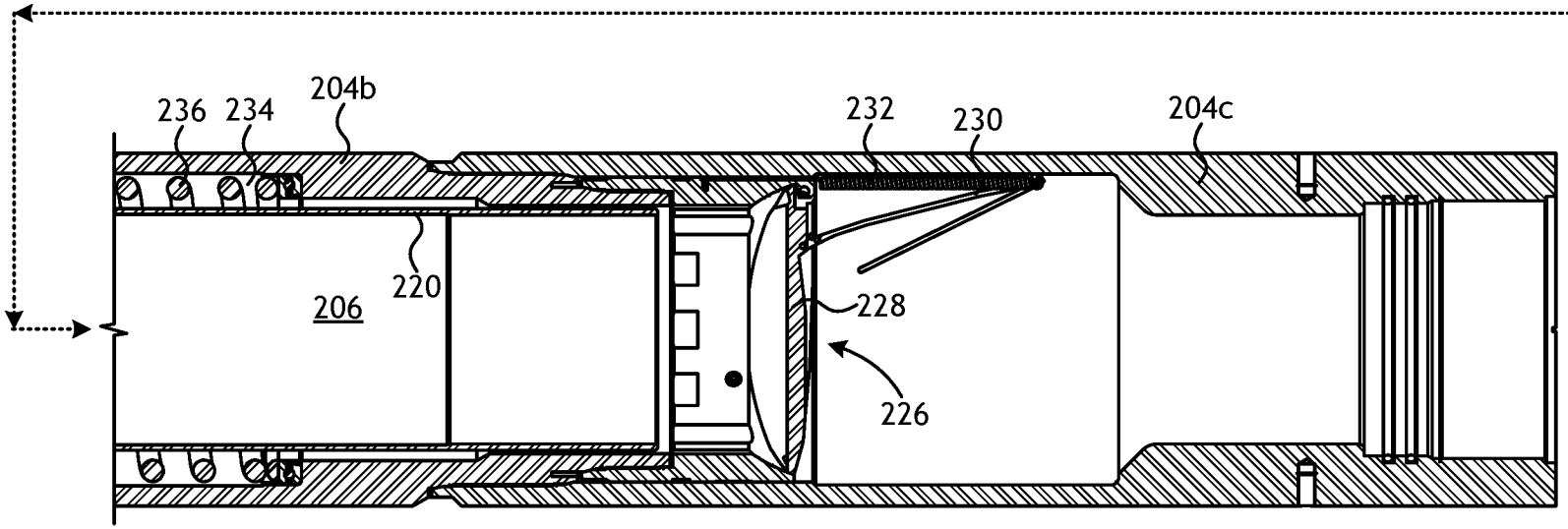

FIGS. 4A-4C are progressive cross-sectional side views of the safety valve 112 and an exemplary lock-open tool 402, as taken along lines 4A-4C shown in the depicted end view. FIGS. 4A-4C are successive sectional views of the safety valve 112, where FIG. 4A depicts the upper portion of the safety valve 112, FIG. 4B depicts a successive central portion of the safety valve 112, and FIG. 4C depicts a successive lower portion of the safety valve 112. Similar reference numerals used in prior figures will refer to similar components or elements that may not be described again. In the view of FIGS. 4A-4C, the actuation piston 212 is depicted within the actuation piston bore 210 and the safety valve 112 is shown in the closed configuration, where the flow tube 220 is retracted upwards within the central flow passageway 206, thereby allowing the flapper 228 to pivot to the closed position.

As illustrated, the lock-open tool 402 includes a cylindrical housing 404 that defines an inner flow bore 406 that transitions into an inner flow chamber 408. The inner flow chamber 408 exhibits a smaller diameter than the inner flow bore 406 and is in fluid communication with the inner flow bore 406 via a central aperture 412 and one or more flow conduits 414 (two shown in FIG. 4A). A cap 416 is secured to the downhole end of the housing 404 and thereby secures a dart seat 418 within the inner flow chamber 408. The cap 416 defines a cap flow path 420 and the dart seat 416 defines a dart flow path 422 that fluidly communicates with the cap flow path 420. Accordingly, a fluid may pass through the housing 404 by circulating through the inner flow bore 406, then through the inner flow chamber 408 via the central aperture 412 and/or the flow conduits 414, and finally through the cap and dart flow paths 420, 422.

The lock-open tool 402 may be run into the well with a pulling tool 424 and a dart 426 that extends axially from the pulling tool 424. A jarring tool (not shown) may be operatively coupled to the upper end of the pulling tool 424 and configured to generate jarring loads that can be transmitted to the housing 404 via the dart 426. As used herein, the phrases "jarring down" and "jarring up," and variations thereof, refer to the jarring tool generating an axial impulse load that is transferred to the housing 404 via the dart 426. In particular, "jarring up" means that an upward impulse of force is applied to the housing 404 via the dart 426, and "jarring down" means that a downward impulse of force is applied to the housing 404 via the dart 426.

The dart 426 may have a first or upper end 428*a*, a second or lower end 428*b*, and a shaft 430 that extends between the upper and lower ends 428*a,b*. The upper end 428*a* of the dart 426 may be coupled to a retainer device 432 that is received and secured within a collet 434 provided on the bottom end of the pulling tool 424. The lower end 428*b* of the dart 426 may provide and otherwise define a head 436 configured to be received within the inner flow chamber 408. The head 436 exhibits a diameter that is greater than the diameter of the shaft 430 and the central aperture 412 of the housing 404. Accordingly, when the cap 416 and the dart seat 418 are secured to the downhole end of the housing 404, and the shaft 430 is extended through the central aperture 412, the head 436 of the dart 426 will be secured within the inner flow chamber 408.

The lock-open tool 402 is depicted in FIG. 4A as being received within the central flow passageway 206. More particularly, the lock-open tool 402 includes an upper seal 438*a* configured to sealingly engage the upper seal bore 328*a* and a lower seal 438*b* configured to sealingly engage the lower seal bore 328*b*. Accordingly, the lock-open tool 402 may be advanced within the central flow passageway 206 until the upper and lower seals 438*a,b* axially span the filter 320 and an outer profile 440 engages the no-go profile 326 of the upper sub 204*b*. In the illustrated embodiment, the outer profile 440 comprises an enlarged diameter portion of the housing 404 that engages the no-go profile 326 and thereby stops the axial advancement of the lock-open tool 402. In other embodiments, however, the outer profile 440 may comprise a series of groove and/or protrusions that match or selectively the no-go profile 326. The outer profile 440 may be provided such that it engages the no-go profile 326 when the upper and lower seals 438*a,b* axially span the filter 320.

Figure 5A:
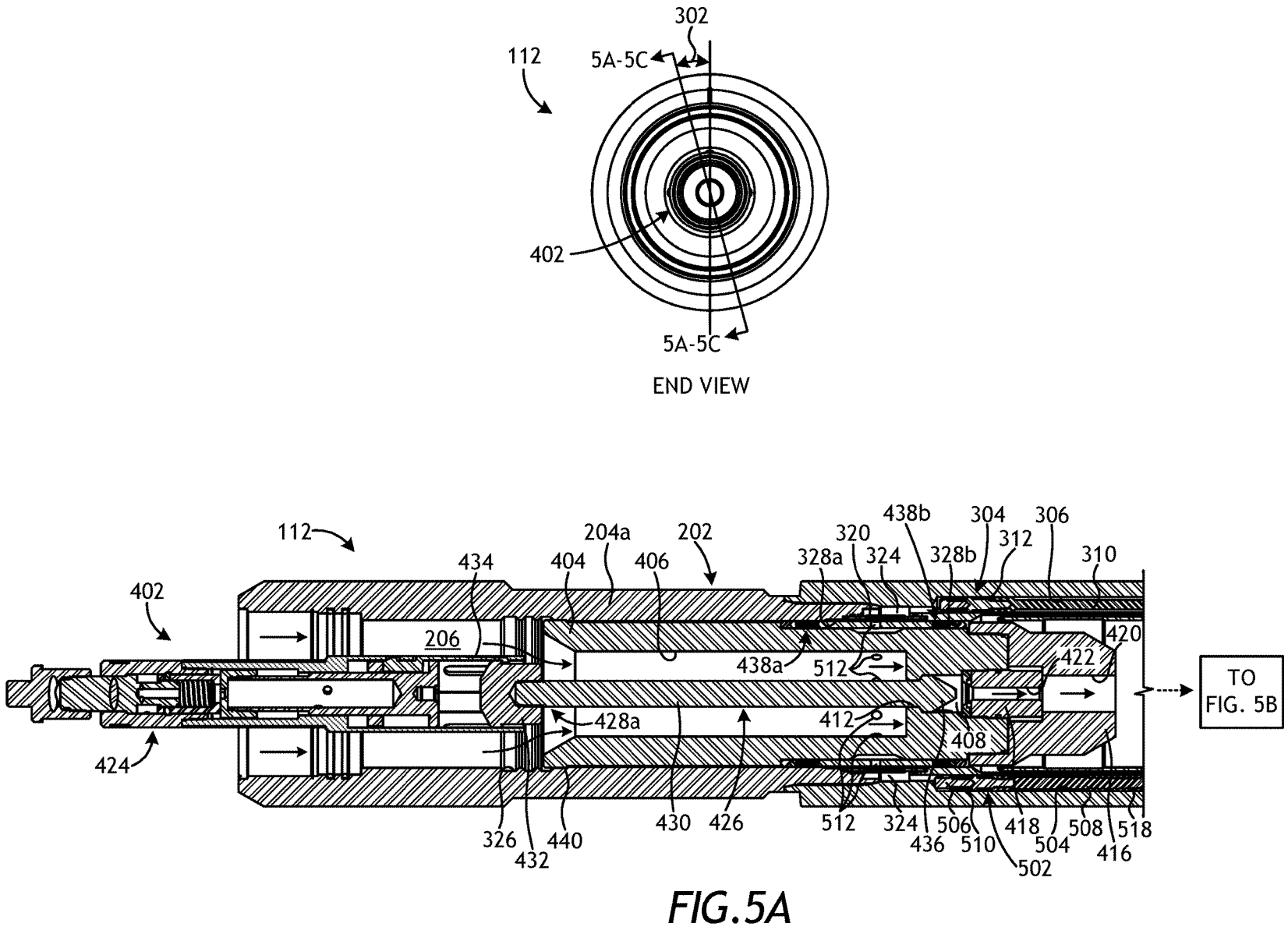
FIGS. 5A-5C are progressive cross-sectional side views of the safety valve of FIG. 1, as taken along lines 5A-5C in the depicted end view.
Figure 5B:
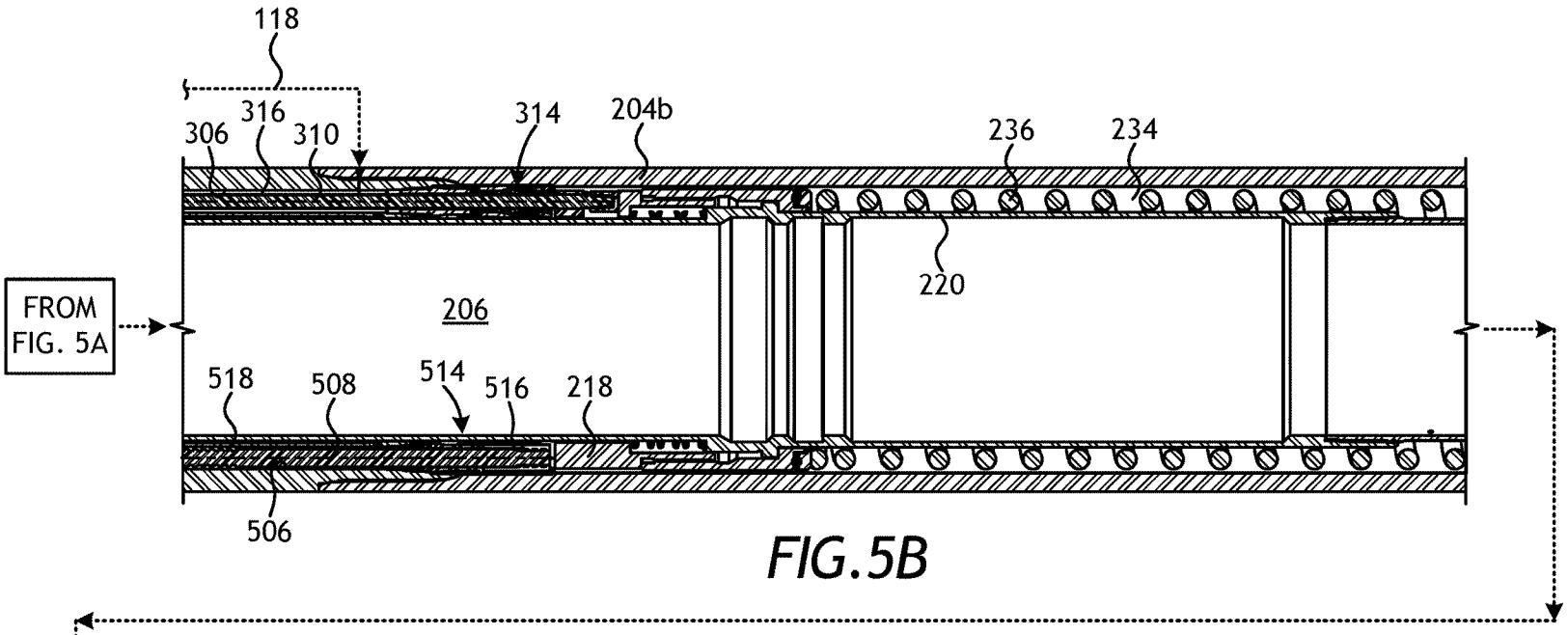
Figure 5C:
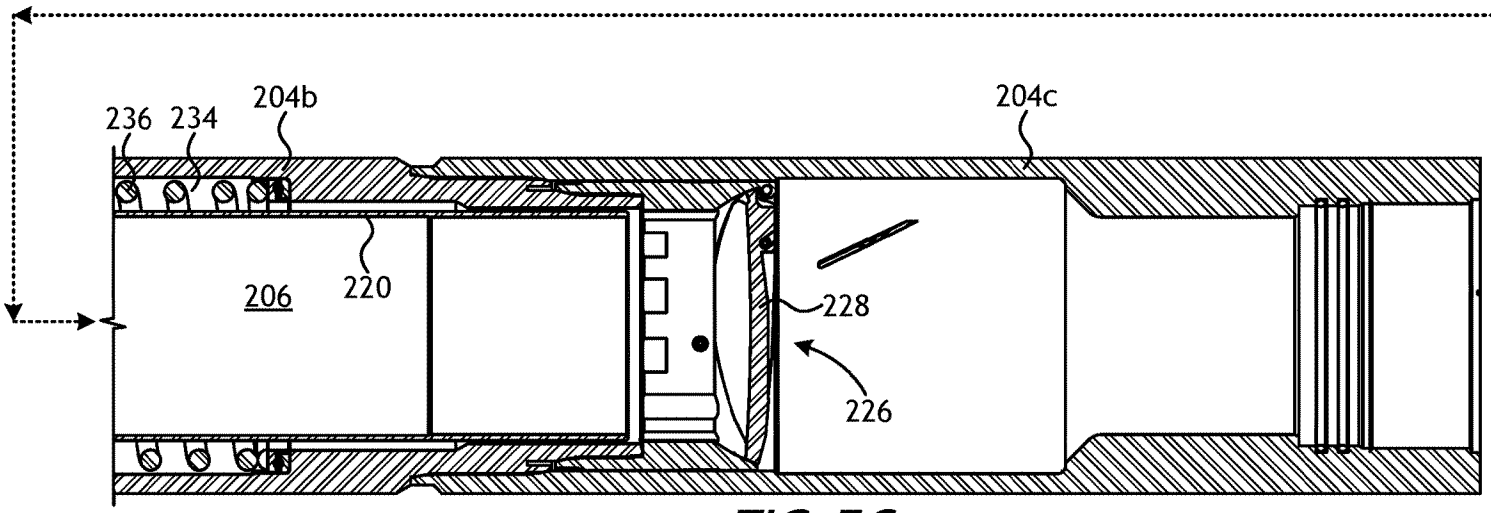

FIGS. 5A-5C are progressive cross-sectional side views of the safety valve 112 and the lock-open tool 402, as taken along lines 5A-5C shown in the depicted end view. Similar to FIGS. 4A-4C, FIGS. 5A-5C are successive sectional views of the safety valve 112, but viewed at the angular offset 302. Accordingly, the actuation piston bore 210 and associated actuation piston 212 are not depicted in FIGS. 5A-5C. Rather, the balance piston 304 is shown within the balance piston bore 306. Moreover, similar to FIGS. 4A-4C, FIGS. 5A-5C also depict the safety valve 112 in the closed configuration, where the flow tube 220 is retracted upwards within the central flow passageway 206 and the flapper 228 is moved to the closed position.

As illustrated, the safety valve 112 may further include a lock-open piston 502 movably arranged within a lock-open piston bore 504 defined in the housing 202 and, more particularly, within the central sub 204*b*. While only one lock-open piston 502 is shown and described herein, it will be appreciated that the safety valve 112 may include more than one lock-open piston 502, without departing from the scope of the disclosure.

The lock-open piston 502 includes a head 506 and a lock-open piston rod 508 that extends longitudinally from the head 506 through at least a portion of the lock-open piston bore 504. Unlike the actuation piston 212 (FIGS. 2A and 4A) and the balance piston 304, however, the bottom end of the lock-open piston rod 508 is not coupled to the actuator sleeve 218 and, therefore, does not move within the lock-open piston bore 504 as the flow tube 220 moves within the central flow passageway 306. Rather, the bottom end of the lock-open piston rod 508 may be able to axially engage the actuator sleeve 218 upon moving in the downhole direction, and thereby help move the flow tube 220 downwards and open the flapper 228 when actuated.

The lock-open piston 502 may further include a set of dynamic seals 510 at or near the head 506 to seal against the inner diameter of the lock-open piston bore 504 as the lock-open piston 502 moves therein. The dynamic seals 510 may be similar to the dynamic seals 312 of the balance piston 304 and, therefore, will not be described again.

Similar to the balance piston 304, the upper and lower ends of the lock-open piston 502 may be exposed to the tubing pressure. More particularly, the lock-open piston bore 504 may be in fluid communication with the filter chamber 324, which fluidly communicates with the central flow passageway 206 via the filter 320. Accordingly, tubing pressure is able to enter the lock-open piston bore 504 uphole from the lock-open piston 502 via the filter 320 and the filter chamber 324. Moreover, the lower end of the lock-open piston 502 is exposed to the tubing pressure via the un-sealed flow tube 220.

The lock-open tool 402 may be installed within the safety valve 112 by advancing the lock-open tool 402 through the tubing string 114 (FIG. 1) on a conveyance (e.g., wireline, slickline, coiled tubing, drill pipe, production tubing, etc.) until locating the safety valve 112 and entering the central flow passageway 206. The jarring tool (not shown) operatively coupled to the uphole end of the pulling tool 424 may be actuated to jar down on the housing 404 until the outer profile 440 engages the no-go profile 326 of the upper sub 204*b* and the upper and lower seals 438*a,b* axially span the filter 320.

With the head 436 of the dart 426 lifted off the dart seat 418, as shown in FIG. 5A, tubing pressure applied from the surface through the tubing string 114 may pass through the lock-open tool 402, as indicated by the arrows.

More particularly, the fluid may circulate through the inner flow bore 406, the inner flow chamber 408 via the central aperture 412 and/or the flow conduits 414 (FIG. 4A), and finally through the cap and dart flow paths 420, 422 to flow within the lower portions of the central flow passageway 206. Moreover, the fluid entering the inner flow bore 406 may also be conveyed into the filter chamber 324 via a plurality of radial ports 512 defined through the housing 404.

The fluid passing through the safety valve 112 may help equalize the hydrostatic pressure across the flapper 228 (FIG. 5C), which may help move the flapper 228 to its open position. In at least one embodiment, however, a prong or rod (not shown) may be coupled to the lower end of the lock-open tool 402, such as at the cap 416, and extend longitudinally downhole to engage the flapper 228. The length of the rod could be sized such that setting the lock-open tool 402 within the safety valve 112, as described above, would allow the rod to engage and prop the flapper 228 at least partially open. As a result, fluid pressure within the central flow passageway 206 on either side of the flapper 228 would be equalized.

Figure 6A:
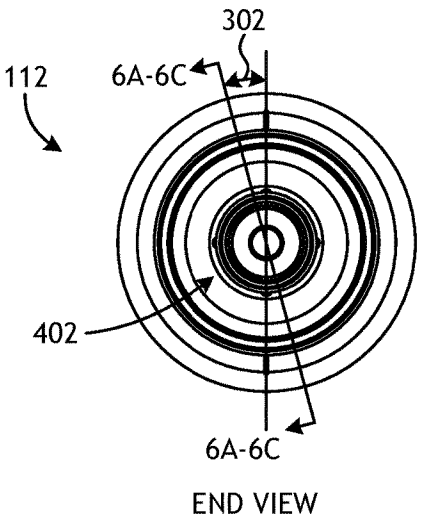
FIGS. 6A-6C are progressive cross-sectional side views of the safety valve of FIG. 1, as taken along lines 6A-6C in the depicted end view.
Figure 6A:
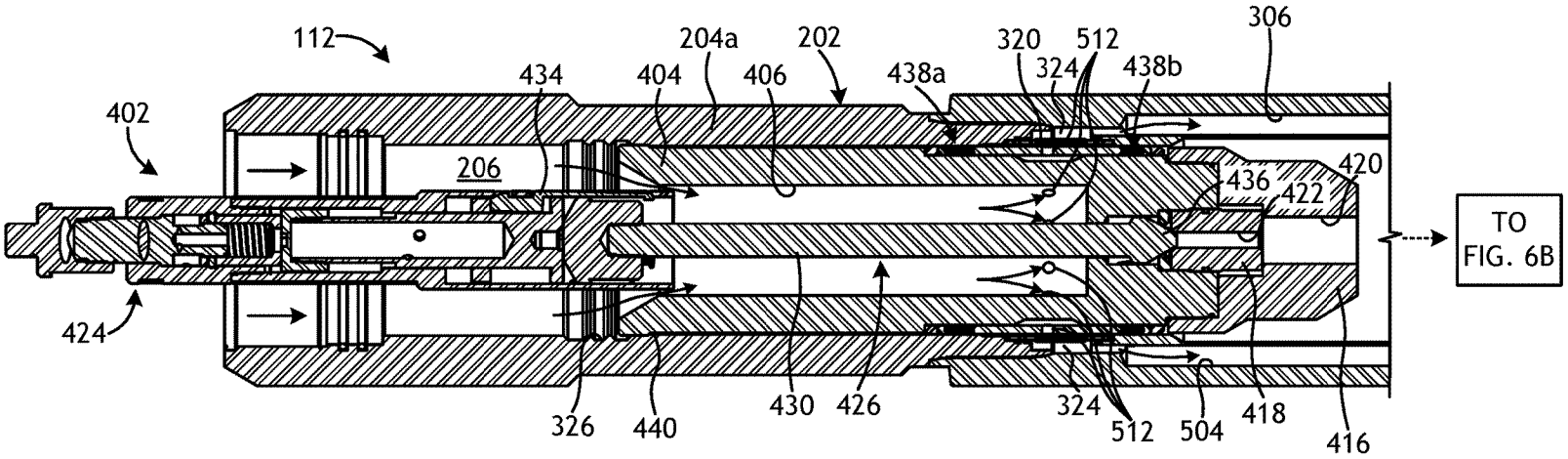
Figure 6B:
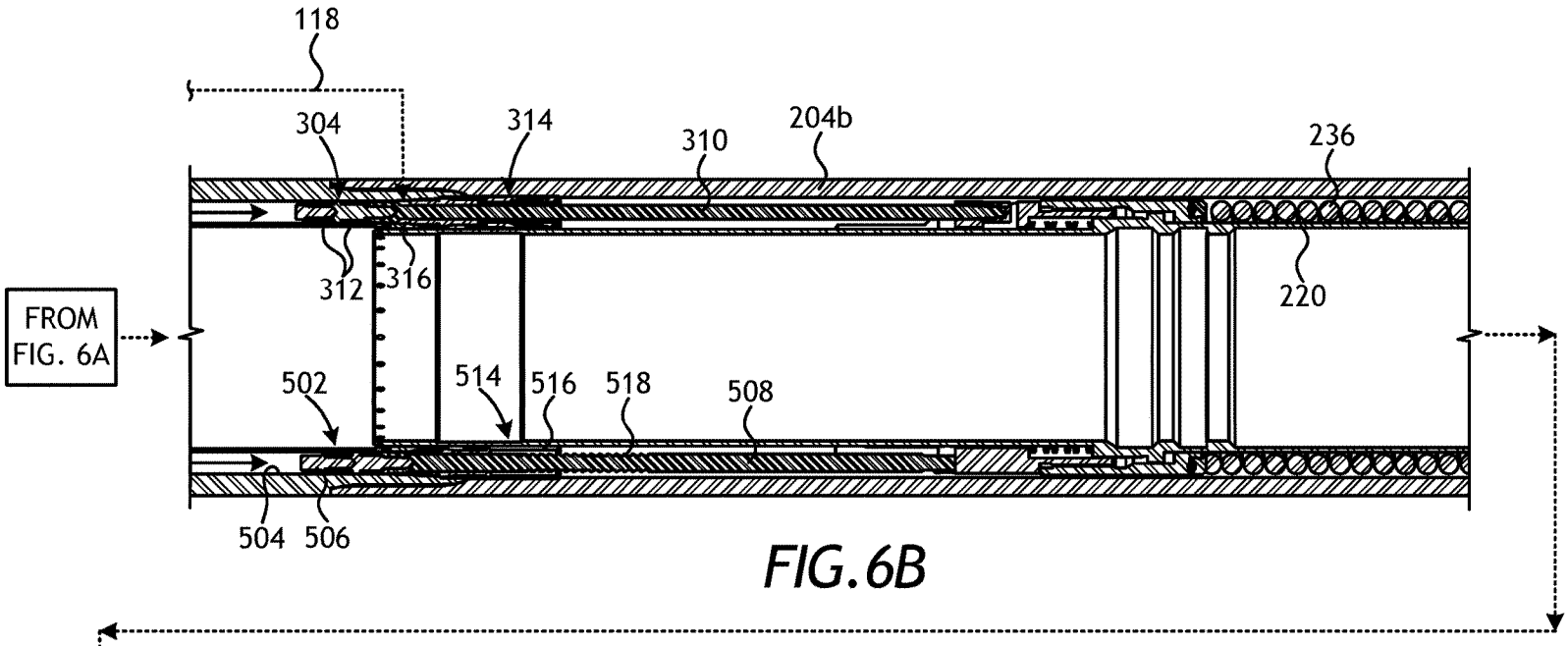
Figure 6C:
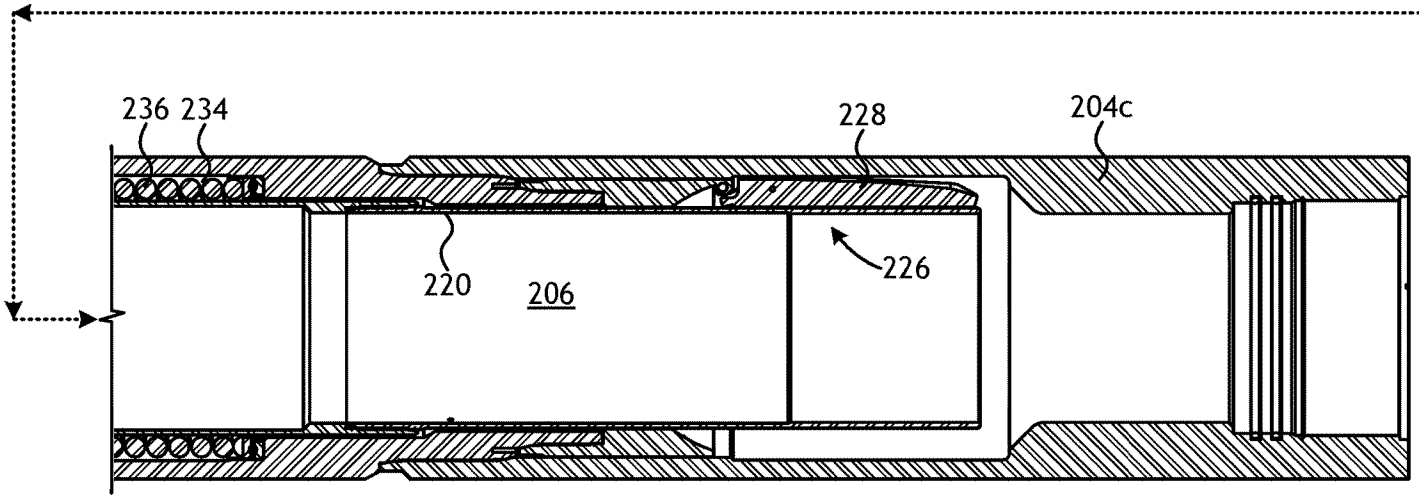

FIGS. 6A-6C are progressive cross-sectional side views of the safety valve 112 and the lock-open tool 402, as taken along lines 6A-6C shown in the depicted end view. Similar to FIGS. 5A-5C, FIGS. 6A-6C are successive sectional views of the safety valve 112 viewed at the angular offset 302. Accordingly, FIGS. 6A-6C depict the balance piston 304 and the lock-open piston 502 movably arranged within the balance piston bore 306 and the lock-open piston bore 504, respectively. Unlike FIGS. 5A-5C, however, FIGS. 6A-6C depict the safety valve 112 in the open configuration, where the flow tube 220 is extended downwards within the central flow passageway 206 and thereby props the flapper 228 in the open position. Moreover, FIGS. 6A-6C also depict the lock-open piston 502 as having moved from an initial position, as shown in FIGS. 5A-5C, to an actuated position within the lock-open piston bore 504.

After the housing 404 has been jarred downward such that the outer profile 440 engages the no-go profile 326 and the upper and lower seals 438*a,b* axially span the filter 320, an axial load may be applied to the lock-open tool 402 in the downhole direction to seat the head 436 of the dart 426 against the dart seat 418. In some embodiments, for example, the axial load may result from weight being applied on the lock-open tool 402 in the downhole direction from tools (including the pulling tool 424) located uphole from the safety valve 112. The axial load may force the head 436 of the dart 426 into sealing engagement with the dart seat 418, and thereby prevent fluid communication between the inner flow chamber 408 and the cap and dart flow paths 420, 422.

After placing the axial load on the lock-open tool 402, the tubing pressure conveyed through the tubing string 114 (FIG. 1) to the central flow passageway 206 and, therefore, to the inner flow bore 406 may then be increased and flow into the filter chamber 324 via the radial ports 512. The increased tubing pressure may then act on the upper ends of the balance and lock-open pistons 304, 502 within the balance and lock-open piston bores 306, 504, respectively, and overcome the tubing pressure acting on the lower ends of the balance and lock-open pistons 304, 502 via the unsealed flow tube 220. As a result, the balance and lock-open pistons 304, 502 may move axially downward within the balance and lock-open piston bores 306, 504, respectively.

As the actuation piston 212, the balance piston 304, and the lock-open piston(s) 502 move axially downward, the flow tube 220 may correspondingly move in the downhole direction to engage and open the flapper 328. During this movement, in some embodiments, the hydraulic control line 116 (FIG. 1) that provides control line pressure to the actuation bore 210 (FIGS. 2A and 4A) may be set to the open position so that hydraulic pressure down the control line 116 can also assist to lock open the safety valve 112. The balance line 118 (FIG. 1) during this time is open at the surface. As will be appreciated, this allows the control line 116 to assist the surface pressure applied down the production tubing to open the flapper 328. In other embodiments, however, the control line 116 may simultaneously convey control line pressure to the actuation bore 210 and the actuation piston 212 (FIGS. 2A and 4A) may thereby help move the flow tube 220 and open the flapper 328.

The safety valve 112 may further include a locking mechanism 514 arranged in the lock-open piston bore 504 to secure the lock-open piston 502 in the actuated position, and thereby effectively secure the flapper 228 in the open position. In at least one embodiment, as shown in FIGS. 5A-5B and 6B, the locking mechanism 514 may comprise a collet 516 fixed in place within the lock-open piston bore 504 and a series of grooves or teeth 518 defined on the outer surface of the lock-open piston rod 508. The collet 516 may be configured to receive the lock-open piston rod 508 as the lock-open piston 502 moves in the downhole direction from the initial position (FIGS. 5A-5C) to the actuated position (FIGS. 6A-6C). As the lock-open piston rod 508 advances through the collet 516 in the downhole direction, the teeth 518 may be angled such that the collet 516 is able to ratchet over the teeth 518. The angle of the teeth 518, however, may further be angled such that movement of the lock-open piston rod 508 in the opposing uphole direction is substantially prevented as the collet 516 engages the teeth 518. Accordingly, the locking mechanism 514 may be configured to prevent the lock-open piston 502 from retracting back uphole, which prevents the flow tube 220 from retracting and thereby permanently locks the flapper 228 in the open position.

While the locking mechanism 514 is depicted and described herein as a collet assembly that includes the collet 516 and the teeth 518, it will be appreciated that other types and designs of the locking mechanism may equally be employed in the safety valve 112 to accomplish the same purpose, without departing from the scope of the disclosure. In other embodiments, for instance, the locking mechanism 514 may include a snap ring (not shown) configured to radially contract and seat within a groove (not shown) on the outer surface of the lock-open piston rod 508 once the lock-open piston 502 has advanced downhole within the lock-open piston bore 504 to locate the snap ring in the groove.

Once the lock-open piston 502 is secured in the actuated position with the locking mechanism 514, and the safety valve 112 is thereby permanently locked in the open configuration, the lock-open tool 402 may be removed from the safety valve 112. To accomplish this, the jarring tool (not shown) operatively coupled to the uphole end of the pulling tool 424 may provide an upward jarring force on the housing 404 until the housing 404 is retracted out of the central flow passageway 206. Once free from the central flow passageway 206, the lock-open tool 402 may be returned to the surface of the well by retracting the conveyance coupled to the lock-open tool 402.

Embodiments disclosed herein include:

A. A well system that includes a tubing string extendable within a wellbore, and a subsurface safety valve interconnected with the tubing string. The subsurface safety valve including a housing that defines a central flow passageway and includes a flapper pivotable within the central flow passageway between closed and open positions, a flow tube movably positioned within the central flow passageway and engageable with the flapper to move the flapper to the open position, an actuation piston movably positioned within an actuation piston bore defined in a wall of the housing and operatively coupled to the flow tube, a balance piston movably positioned within a balance piston bore defined in the wall and operatively coupled to the flow tube, and a lock-open piston movably positioned within a lock-open piston bore defined in the wall and engageable with an actuator sleeve operatively coupled to the flow tube. The well system further including a lock-open tool positionable within the central flow passageway to convey hydraulic pressure into the lock-open piston bore and thereby actuate the lock-open piston to an actuated position that moves the flow tube and permanently locks the flapper in the open position.

B. A method that includes advancing a lock-open tool within a tubing string to a subsurface safety valve interconnected with the tubing string. The subsurface safety valve including a housing that defines a central flow passageway and includes a flapper pivotable within the central flow passageway between closed and open positions, a flow tube movably positioned within the central flow passageway, an actuation piston movably positioned within an actuation piston bore defined in a wall of the housing and operatively coupled to the flow tube, a balance piston movably positioned within a balance piston bore defined in the wall and operatively coupled to the flow tube, a lock-open piston movably positioned within a lock-open piston bore defined in the wall and engageable with an actuator sleeve operatively coupled to the flow tube, and a filter positioned within the central flow passageway to facilitate fluid communication between the central flow passageway and the balance piston bore and the lock-open piston bore. The method further including jarring down on the lock-open tool to sealingly engage an upper seal against an upper seal bore of the housing and sealingly engage a lower seal against a lower seal bore of the housing, wherein the upper and lower seal bores are provided on opposing axial ends of the filter, pressurizing the tubing string and thereby pressurizing the lock-open piston bore via one or more radial flow ports defined in the lock-open tool that fluidly communicate with the filter between the upper and lower seals, and moving the lock-open piston to an actuated position within the lock-open piston bore and thereby advancing the flow tube to move the flapper to the open position.

C. A subsurface safety valve that includes a housing that defines a central flow passageway and includes a flapper pivotable within the central flow passageway between closed and open positions, a flow tube movably positioned within the central flow passageway and engageable with the flapper to move the flapper to the open position, an actuation piston movably positioned within an actuation piston bore defined in a wall of the housing and operatively coupled to the flow tube, a balance piston movably positioned within a balance piston bore defined in the wall and operatively coupled to the flow tube, and a lock-open piston movably arranged within a lock-open piston bore defined in the wall and engageable with an actuator sleeve operatively coupled to the flow tube, wherein the lock-open piston is actuatable to an actuated position that moves the flow tube and permanently locks the flapper in the open position.

Each of embodiments A, B, and C may have one or more of the following additional elements in any combination: Element 1: wherein the subsurface safety valve further includes a filter positioned within the central flow passageway to facilitate fluid communication between the central flow passageway and the balance piston bore and the lock-open piston bore. Element 2: wherein the lock-open tool comprises a cylindrical housing defining an inner flow bore that transitions into an inner flow chamber, an upper seal provided on the cylindrical housing to sealingly engage an upper seal bore provided within the central flow passageway, and a lower seal provided on the cylindrical housing to sealingly engage a lower seal bore provided within the central flow passageway, wherein the upper and lower seal bores are provided on opposing axial ends of the filter. Element 3: wherein the lock-open tool further comprises a plurality of radial flow ports defined in the cylindrical housing to provide fluid communication between the inner flow bore and the balance piston bore and the lock-open piston bore via the filter, a dart seat secured within the inner flow chamber, and a dart extending longitudinally within the cylindrical housing and providing a head positioned within the inner flow chamber to sealingly engage the dart seat and thereby divert fluid pressure through the radial flow ports and into the balance piston bore and the lock-open piston bore. Element 4: wherein the lock-open tool comprises an outer profile engageable with a no-go profile defined in the central flow passageway. Element 5: wherein upper and lower ends of each of the balance piston and the lock-open piston are exposed to tubing pressure present in the central flow passageway. Element 6: wherein the subsurface safety valve further includes a locking mechanism arranged in the lock-open piston bore to secure the lock-open piston in the actuated position.

Element 7: wherein jarring down on the lock-open tool further comprises jarring down on the lock-open tool until an outer profile provided on the lock-open tool engages a no-go profile defined on an inner surface of the central flow passage. Element 8: further comprising locking the lock-open piston in the actuated position with a locking mechanism arranged in the lock-open piston bore. Element 9: wherein pressurizing the tubing string further comprises pressurizing the balance piston bore via the one or more radial flow ports and thereby moving the balance piston within the balance piston bore. Element 10: wherein pressurizing the tubing string and thereby pressurizing the lock-open piston bore is preceded by applying an axial load on the lock-open tool and thereby forcing a head of a dart into sealing engagement with a dart seat secured within an inner flow chamber of the lock-open tool. Element 11: further comprising securing the lock-open piston in the actuated position with a locking mechanism arranged in the lock-open piston bore. Element 12: further comprising jarring up on the lock-open tool to retract the lock-open tool from the central flow passageway.

Element 13: further comprising a filter positioned within the central flow passageway to facilitate fluid communication between the central flow passageway and the balance piston bore and the lock-open piston bore. Element 14: wherein the filter defines slots to filter debris of a predetermined size from entering the balance piston bore and the lock-open piston bore. Element 15: wherein upper and lower ends of each of the balance piston and the lock-open piston are exposed to tubing pressure present in the central flow passageway. Element 16: further comprising a locking mechanism arranged in the lock-open piston bore that secures the lock-open piston in the actuated position. Element 17: wherein the locking mechanism comprises a collet fixed within the lock-open piston bore, a series of teeth defined on an outer surface of the lock-open piston rod, wherein the collet receives the lock-open piston rod and ratchets against the series of teeth as the lock-open piston moves to the actuated position, and wherein the collet engages the teeth to secure lock-open piston in the actuated position.

By way of non-limiting example, exemplary combinations applicable to A, B, and C include: Element 1 with Element 2; Element 2 with Element 3; Element 13 with Element 14; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure or component and the downward direction being toward the bottom of the corresponding figure or component, the uphole direction being toward the surface of the well and the downhole direction being toward the toe of the well.

What is claimed is:

1. A well system, comprising:

a tubing string extendable within a wellbore;

a subsurface safety valve interconnected with the tubing string and including:

a housing that defines a central flow passageway and includes a flapper pivotable within the central flow passageway between closed and open positions;

a flow tube movably positioned within the central flow passageway and engageable with the flapper to move the flapper to the open position;

an actuation piston movably positioned within an actuation piston bore defined in a wall of the housing and operatively coupled to the flow tube;

a balance piston movably positioned within a balance piston bore defined in the wall and operatively coupled to the flow tube; and a lock-open piston movably positioned within a lock-open piston bore defined in the wall and engageable with an actuator sleeve operatively coupled to the flow tube; and a lock-open tool positionable within the central flow passageway to convey hydraulic pressure into the lock-open piston bore and thereby actuate the lock-open piston to an actuated position that moves the flow tube and permanently locks the flapper in the open position.

2. The well system of claim 1, wherein the subsurface safety valve further includes a filter positioned within the central flow passageway to facilitate fluid communication between the central flow passageway and the balance piston bore and the lock-open piston bore.

3. The well system of claim 2, wherein the lock-open tool comprises:

a cylindrical housing defining an inner flow bore that transitions into an inner flow chamber;

an upper seal provided on the cylindrical housing to sealingly engage an upper seal bore provided within the central flow passageway; and a lower seal provided on the cylindrical housing to sealingly engage a lower seal bore provided within the central flow passageway, wherein the upper and lower seal bores are provided on opposing axial ends of the filter.

4. The well system of claim 3, wherein the lock-open tool further comprises:

a plurality of radial flow ports defined in the cylindrical housing to provide fluid communication between the inner flow bore and the balance piston bore and the lock-open piston bore via the filter;

a dart seat secured within the inner flow chamber; and a dart extending longitudinally within the cylindrical housing and providing a head positioned within the inner flow chamber to sealingly engage the dart seat and thereby divert fluid pressure through the radial flow ports and into the balance piston bore and the lock-open piston bore.

5. The well system of claim 1, wherein the lock-open tool comprises an outer profile engageable with a no-go profile defined in the central flow passageway.

6. The well system of claim 1, wherein upper and lower ends of each of the balance piston and the lock-open piston are exposed to tubing pressure present in the central flow passageway.

7. The well system of claim 1, wherein the subsurface safety valve further includes a locking mechanism arranged in the lock-open piston bore to secure the lock-open piston in the actuated position.

8. A method, comprising:

advancing a lock-open tool within a tubing string to a subsurface safety valve interconnected with the tubing string, the subsurface safety valve including:

a housing that defines a central flow passageway and includes a flapper pivotable within the central flow passageway between closed and open positions;

a flow tube movably positioned within the central flow passageway;

an actuation piston movably positioned within an actuation piston bore defined in a wall of the housing and operatively coupled to the flow tube;

a balance piston movably positioned within a balance piston bore defined in the wall and operatively coupled to the flow tube;

a lock-open piston movably positioned within a lock-open piston bore defined in the wall and engageable with an actuator sleeve operatively coupled to the flow tube; and a filter positioned within the central flow passageway to facilitate fluid communication between the central flow passageway and the balance piston bore and the lock-open piston bore;

jarring down on the lock-open tool to sealingly engage an upper seal against an upper seal bore of the housing and sealingly engage a lower seal against a lower seal bore of the housing, wherein the upper and lower seal bores are provided on opposing axial ends of the filter;

pressurizing the tubing string and thereby pressurizing the lock-open piston bore via one or more radial flow ports defined in the lock-open tool that fluidly communicate with the filter between the upper and lower seals; and moving the lock-open piston to an actuated position within the lock-open piston bore and thereby advancing the flow tube to move the flapper to the open position.

9. The method of claim 8, wherein jarring down on the lock-open tool further comprises jarring down on the lock-open tool until an outer profile provided on the lock-open tool engages a no-go profile defined on an inner surface of the central flow passage.

10. The method of claim 9, further comprising locking the lock-open piston in the actuated position with a locking mechanism arranged in the lock-open piston bore.

11. The method of claim 9, wherein pressurizing the tubing string further comprises pressurizing the balance piston bore via the one or more radial flow ports and thereby moving the balance piston within the balance piston bore.

12. The method of claim 9, wherein pressurizing the tubing string and thereby pressurizing the lock-open piston bore is preceded by applying an axial load on the lock-open tool and thereby forcing a head of a dart into sealing engagement with a dart seat secured within an inner flow chamber of the lock-open tool.

13. The method of claim 9, further comprising securing the lock-open piston in the actuated position with a locking mechanism arranged in the lock-open piston bore.

14. The method of claim 9, further comprising jarring up on the lock-open tool to retract the lock-open tool from the central flow passageway.

15. A subsurface safety valve, comprising:

a housing that defines a central flow passageway and includes a flapper pivotable within the central flow passageway between closed and open positions;

a flow tube movably positioned within the central flow passageway and engageable with the flapper to move the flapper to the open position;

an actuation piston movably positioned within an actuation piston bore defined in a wall of the housing and operatively coupled to the flow tube;

a balance piston movably positioned within a balance piston bore defined in the wall and operatively coupled to the flow tube; and a lock-open piston movably arranged within a lock-open piston bore defined in the wall and engageable with an actuator sleeve operatively coupled to the flow tube, wherein the lock-open piston is actuatable to an actuated position that moves the flow tube and permanently locks the flapper in the open position.

16. The subsurface safety valve of claim 15, further comprising a filter positioned within the central flow passageway to facilitate fluid communication between the central flow passageway and the balance piston bore and the lock-open piston bore.

17. The subsurface safety valve of claim 16, wherein the filter defines slots to filter debris of a predetermined size from entering the balance piston bore and the lock-open piston bore.

18. The subsurface safety valve of claim 15, wherein upper and lower ends of each of the balance piston and the lock-open piston are exposed to tubing pressure present in the central flow passageway.

19. The subsurface safety valve of claim 15, further comprising a locking mechanism arranged in the lock-open piston bore that secures the lock-open piston in the actuated position.

20. The subsurface safety valve of claim 19, wherein the locking mechanism comprises:

a collet fixed within the lock-open piston bore;

a series of teeth defined on an outer surface of a lock-open piston rod, wherein the collet receives the lock-open piston rod and ratchets against the series of teeth as the lock-open piston moves to the actuated position, and wherein the collet engages the teeth to secure the lock-open piston in the actuated position.

* * * * *